US008919447B2

(12) United States Patent
Thuet et al.

(10) Patent No.: US 8,919,447 B2
(45) Date of Patent: Dec. 30, 2014

(54) UNDERSEA CONNECTOR FOR CONNECTING AN OIL INSTALLATION, THE CONNECTOR BEING PROVIDED WITH AN ANTI-DISCONNECTION DEVICE

(75) Inventors: Sylvain Thuet, Roderen (FR); Pierre Croguenec, Thann (FR)

(73) Assignee: Techlam, Cernay (FR)

( * ) Notice: Subject to any disclaimer, the term of this patent is extended or adjusted under 35 U.S.C. 154(b) by 609 days.

(21) Appl. No.: 13/098,571

(22) Filed: May 2, 2011

(65) Prior Publication Data

US 2011/0268509 A1 Nov. 3, 2011

(30) Foreign Application Priority Data

May 3, 2010 (FR) ..... 10 01885

(51) Int. Cl.
*E21B 7/12* (2006.01)
*B63B 21/50* (2006.01)

(52) U.S. Cl.
CPC ..... *B63B 21/502* (2013.01)
USPC ..... 166/338; 166/341; 166/352; 166/354

(58) Field of Classification Search
USPC ..... 166/338, 341, 352, 354; 405/223.1, 405/224, 228; 285/914, 913, 920, 34, 35
See application file for complete search history.

(56) References Cited

U.S. PATENT DOCUMENTS 2,250,463 A * 7/1941 Boynton ..... 403/13
2,799,344 A * 7/1957 Muse ..... 166/123
3,097,001 A 7/1963 Lebus
3,211,479 A * 10/1965 Brown ..... 285/360
3,577,737 A * 5/1971 Burleson ..... 405/227
3,587,733 A * 6/1971 Miller ..... 166/352
3,697,103 A * 10/1972 Mostyn ..... 403/104
4,061,389 A * 12/1977 Keller et al. ..... 294/86.3
4,133,378 A * 1/1979 Gano ..... 166/242.3
4,199,210 A 4/1980 Trott
4,277,875 A * 7/1981 Worrell ..... 29/253
4,347,012 A * 8/1982 Glidden ..... 403/2
4,400,112 A * 8/1983 Castel et al. ..... 405/224
4,428,433 A * 1/1984 Watkins ..... 166/339
4,429,902 A * 2/1984 Cowan ..... 285/3
4,459,931 A * 7/1984 Glidden ..... 114/230.1
4,459,933 A * 7/1984 Burchett ..... 114/297
4,483,563 A * 11/1984 van der Heyden ..... 294/90
4,554,976 A * 11/1985 Hynes et al. ..... 166/341
4,699,215 A * 10/1987 Cuiper ..... 166/341

(Continued)

FOREIGN PATENT DOCUMENTS

DE 11 13 801 9/1961
FR 2 556 065 6/1985
WO 2008/002151 1/2008
WO 2008/020168 2/2008

*Primary Examiner* — Matthew Buck
*Assistant Examiner* — Aaron Lembo
(74) *Attorney, Agent, or Firm* — Clark & Brody

(57) ABSTRACT

The invention relates to an undersea connector for connecting an oil installation to the sea bottom, the connector being of the type presenting a first tubular element forming a female portion for fastening to the ocean bottom and a second tubular element forming a male portion for connection to the oil installation, wherein the connector comprises at least one anti-disconnection device for the connector, the device being housed in the female portion and comprising means for positioning the device in a first position in which the connector is capable of being disconnected, or else in a second position in which the connector cannot be disconnected.

8 Claims, 4 Drawing Sheets

(56) References Cited

U.S. PATENT DOCUMENTS

| | | | | | |
|---|---|---|---|---|---|
| 4,797,036 | A * | 1/1989 | Collins et al. | 405/224 |
| 4,907,914 | A * | 3/1990 | Gunderson et al. | 405/224 |
| 4,943,187 | A * | 7/1990 | Hopper | 405/190 |
| 4,943,188 | A | 7/1990 | Peppel | |
| 4,968,183 | A * | 11/1990 | Hannus et al. | 405/224 |
| 5,005,650 | A * | 4/1991 | Hopper | 166/339 |
| 5,480,521 | A * | 1/1996 | Snyder et al. | 205/731 |
| 5,741,084 | A * | 4/1998 | Del Rio et al. | 403/349 |
| 5,755,533 | A * | 5/1998 | Snyder et al. | 405/224 |
| 6,231,265 | B1 * | 5/2001 | Rytlewski et al. | 403/322.1 |
| 6,409,428 | B1 * | 6/2002 | Moog | 405/169 |
| 6,470,968 | B1 * | 10/2002 | Turner | 166/348 |
| 6,557,637 | B1 * | 5/2003 | Dore et al. | 166/338 |
| 6,746,182 | B2 * | 6/2004 | Munk et al. | 405/224.2 |
| 6,905,151 | B2 * | 6/2005 | Froment et al. | 285/376 |
| 7,028,777 | B2 * | 4/2006 | Wade et al. | 166/343 |
| 7,373,986 | B2 * | 5/2008 | Pollack et al. | 166/359 |
| 7,540,692 | B2 * | 6/2009 | Munk et al. | 405/224.2 |
| 7,591,315 | B2 * | 9/2009 | Dore et al. | 166/338 |
| 7,621,698 | B2 * | 11/2009 | Pallini et al. | 405/223.1 |
| 7,926,593 | B2 * | 4/2011 | Bailey et al. | 175/87 |
| 7,967,070 | B2 * | 6/2011 | Reddy | 166/341 |
| 8,057,121 | B2 * | 11/2011 | Gallagher | 403/318 |
| 8,157,481 | B1 * | 4/2012 | Doyle et al. | 405/228 |
| 8,322,432 | B2 * | 12/2012 | Bailey et al. | 166/344 |
| 8,511,387 | B2 * | 8/2013 | Fraser et al. | 166/350 |
| 2006/0199433 | A1 * | 9/2006 | Riggs et al. | 439/607 |
| 2008/0143100 | A1 * | 6/2008 | Webster | 285/18 |
| 2010/0139925 | A1 * | 6/2010 | McKay et al. | 166/343 |
| 2010/0288503 | A1 * | 11/2010 | Cuiper et al. | 166/341 |
| 2011/0088909 | A1 * | 4/2011 | Hamblin et al. | 166/340 |
| 2012/0000664 | A1 * | 1/2012 | Nas et al. | 166/344 |

* cited by examiner

Fig.1
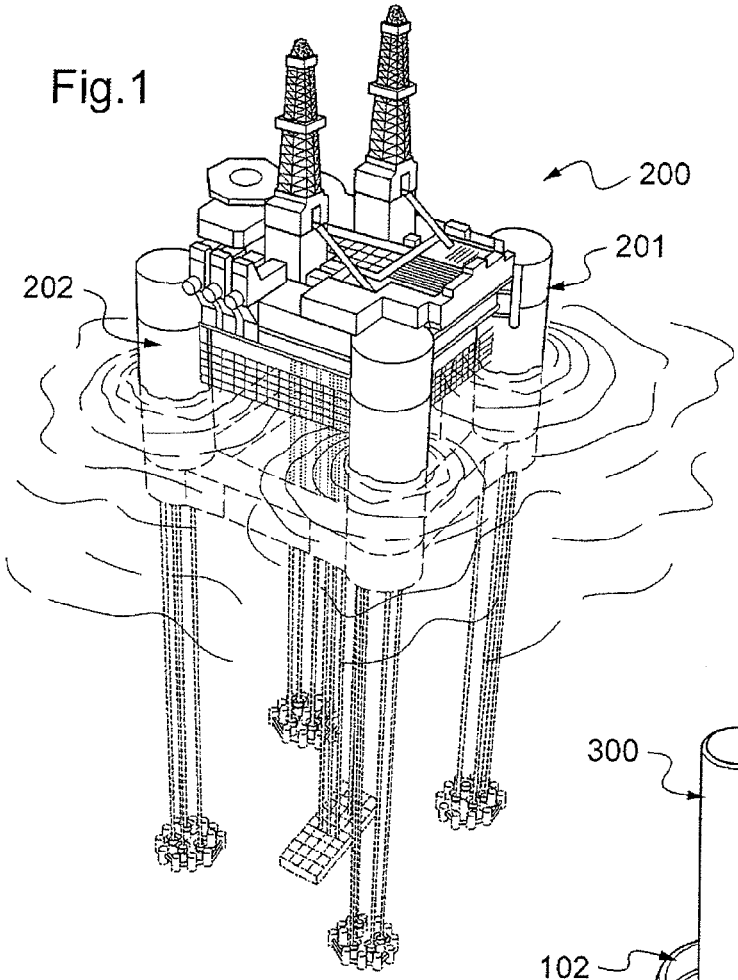
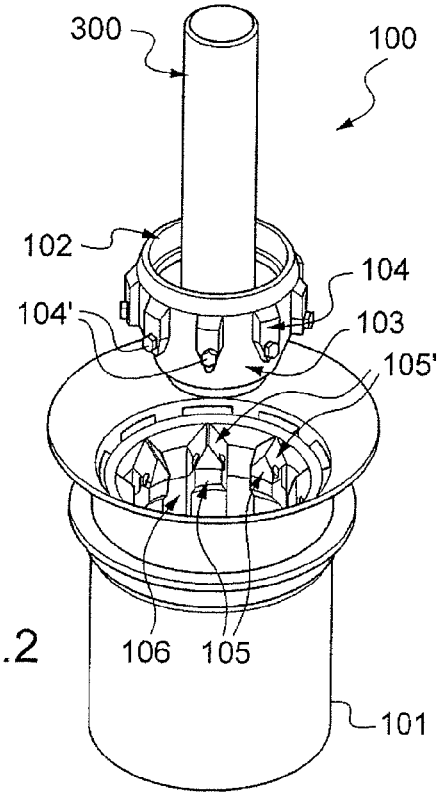
Fig.2

Fig.3c
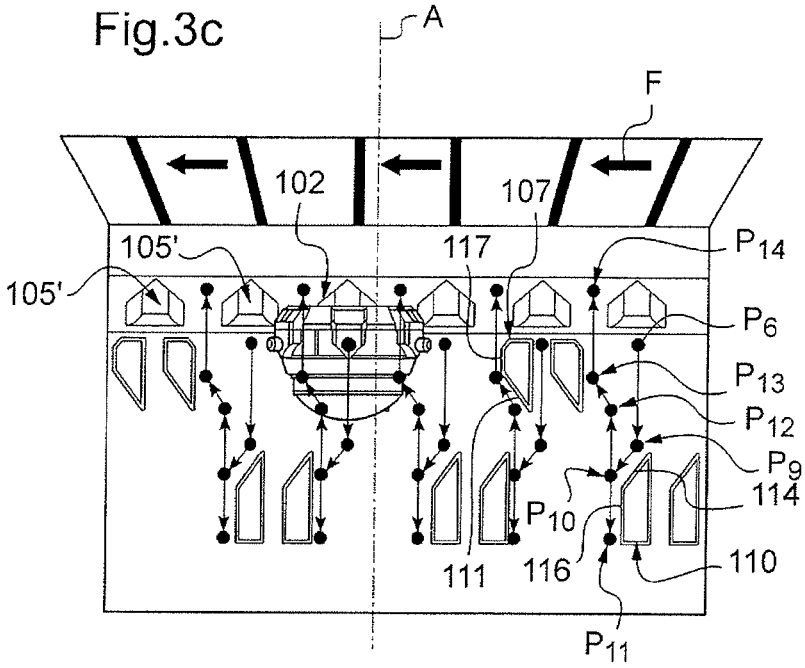
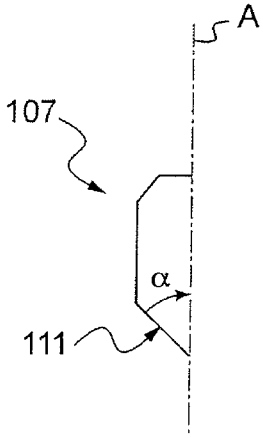
Fig.6a
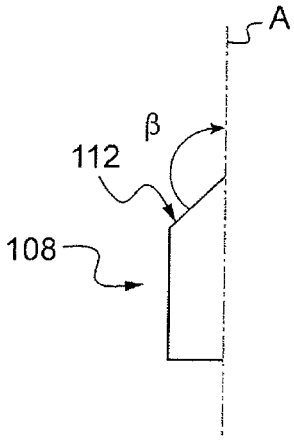
Fig.6b
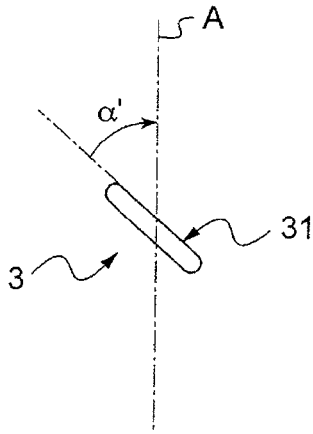
Fig.6c

Fig.4
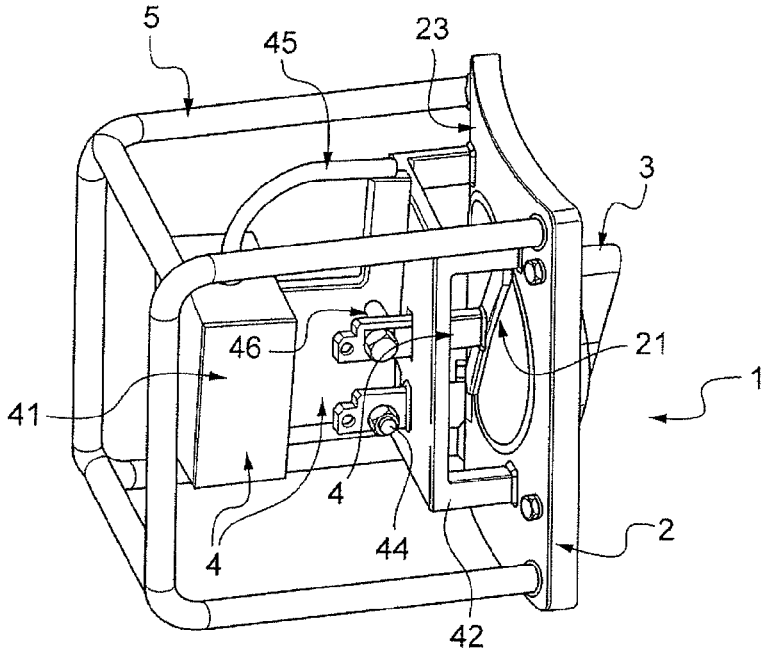
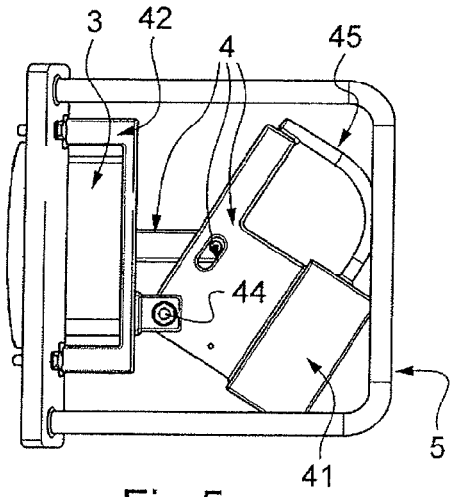
Fig.5a
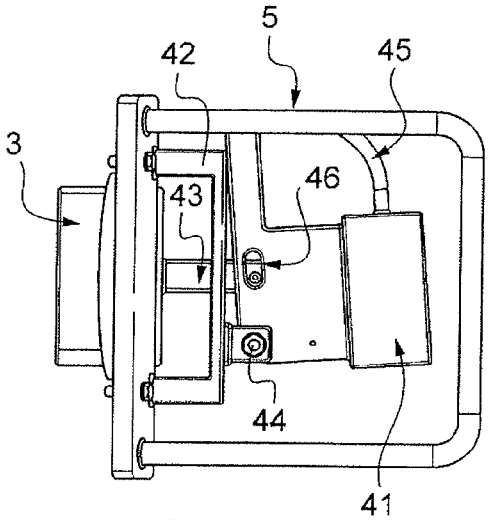
Fig.5b

UNDERSEA CONNECTOR FOR CONNECTING AN OIL INSTALLATION, THE CONNECTOR BEING PROVIDED WITH AN ANTI-DISCONNECTION DEVICE

FIELD OF THE INVENTION

The invention relates to an undersea connector provided with an anti-disconnection device.

BACKGROUND OF THE INVENTION

The invention applies to connecting and disconnecting an oil installation to and from the sea bottom, in which the connector is of the type presenting a first tubular element forming a female portion that is connected to the ocean bottom, and a second tubular element forming a male portion that is connected to the oil installation via a tensioned cable.

More particularly, the invention applies to an undersea connector for an oil installation in which connection/disconnection is performed by performing a movement in rotation between the two tubular elements, as described in document U.S. Pat. No. 4,943,188.

The two portions of the connector are connected together by a downward movement of the male portion (mooring), followed by an upward movement of said male portion during which inclined ramps projecting from the inside wall of the female portion cause the male portion to turn about its axis. This upward rotary movement then enables shoulders of the male portion to be locked against complementary elements of the female portion.

The shoulders of the male portion and the complementary elements of the female portion thus form means for connecting the mooring to the ocean bottom.

Nevertheless, it can happen that the mooring becomes disconnected from the female portion in undesired manner. For example, when installing the mooring, it is possible to lose tension in the cable of the mooring. Under such circumstances, the mooring begins to move up and down, thereby causing uncontrolled movements between the mooring and the female portion of the connector. These movements are likely to cause the mooring to become disconnected from the female portion of the connector.

OBJECT AND SUMMARY OF THE INVENTION

An object of the invention is to propose an undersea connector making it possible to avoid any undesired disconnection of the connector.

To this end, the invention provides an undersea connector for connecting an oil installation to the sea bottom, the connector being of the type presenting a first tubular element forming a female portion for fastening to the ocean bottom and a second tubular element forming a male portion for connection to the oil installation, wherein the connector comprises at least one anti-disconnection device for the connector, the device being housed in the female portion and comprising means for positioning the device in a first position in which the connector is capable of being disconnected, or else in a second position in which the connector cannot be disconnected.

The undersea connector of the invention may also comprise one or more of the following characteristics taken singly or in combination:

said means for positioning the anti-disconnection device in the first position or in the second position comprise:
- a wall provided with a slot;
- a ramp suitable for moving through the slot between the first position and the second position; and
- means for actuating movement of the ramp through the slot between these two positions;

the wall of the anti-disconnection device is complementary in shape to the female portion of the connector;

the means for actuating the movement of the ramp through the slot of the wall comprise:
- a counterweight;
- an intermediate part arranged between the wall and the counterweight, said part being fastened to the wall to support the counterweight, the counterweight being pivotally mounted relative to said intermediate part; and
- a rod having one end fastened to the ramp and having its other end mounted on the counterweight in such a manner that the rod moves axially when the counterweight pivots relative to the intermediate part;

the anti-disconnection device includes a protective frame fastened on an outside face of the wall;

the protective frame presents the shape of a tubular frame so that it can be gripped by an undersea robot;

the female portion also includes upper ramps and lower ramps for guiding the male portion in the female portion during stages of connection, of disconnection, or of anti-disconnection, the ramp of said at least one anti-disconnection device being arranged in an intermediate position between the upper ramps and the lower ramps;

the ramp includes an inclined face that is inclined relative to the longitudinal axis of the female portion of the connector by an angle $\alpha'$;

the angle of inclination $\alpha'$ lies in the range 30° to 60°, and is preferably 45°; and the angle of inclination $\alpha'$ is identical to the angle of inclination $\alpha$ between a face of an upper ramp and the longitudinal axis of the female portion of the connector.

BRIEF DESCRIPTION OF THE DRAWINGS

The invention can be better understood and other objects, advantages, and characteristics thereof appear more clearly on reading the following description made with reference to the accompanying drawings, in which:

FIG. 1 is a perspective view of an off-shore platform on tension legs;

FIG. 2 is a perspective view of a rotary type connector including a male portion mounted on a tension leg connected to the platform shown in FIG. 1 and a female portion secured to the sea bottom;

FIG. 4 is a rear perspective view showing an anti-disconnection device for an undersea connector designed to be installed as a complementary shape on the female portion of said connector;

FIG. 5, which comprises FIGS. 5*a* and 5*b* shows in side view the disposition of the FIG. 4 anti-disconnection device when it is desired to disconnect the male and female portions of the connector, in FIG. 5*a*, and when it is desired to avoid any undesired disconnection of the male and female portions of the connector, in FIG. 5*b*; and FIG. 6, which comprises FIGS. 6*a* to 6*c*, is a diagram showing the angles of inclination made by certain guide ramps surfaces of the female portion of the connector relative to the longitudinal axis A of said female portion.

MORE DETAILED DESCRIPTION

Figure 3A:
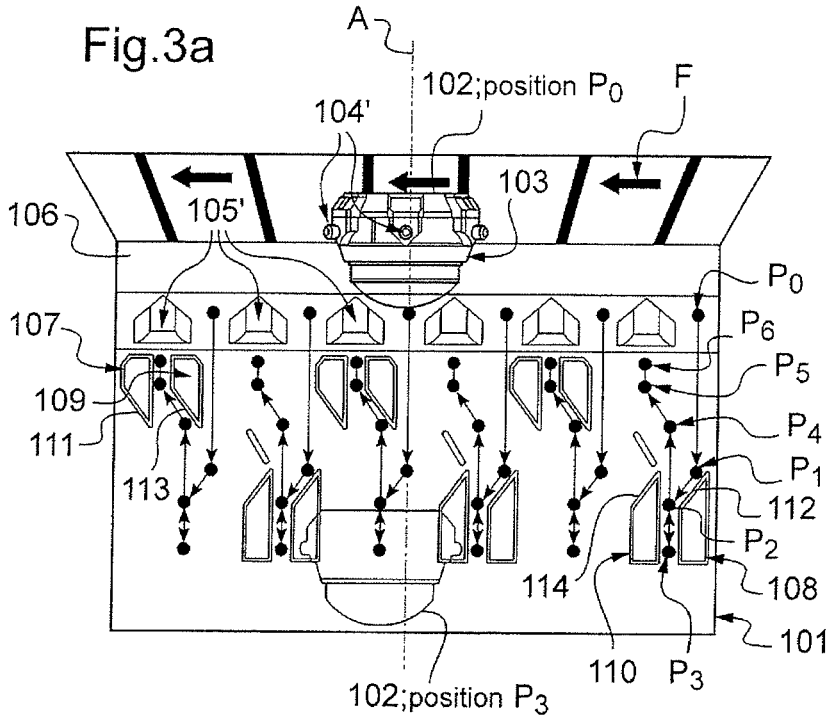
FIG. 3, which is made up of FIGS. 3*a*, 3*b*, and 3*c*, shows the relative movement between the male portion of the connector and the corresponding female portion shown in FIG. 2, firstly during a stage of connecting the connector in FIG. 3*a*, secondly during a stage of undesired disconnection of the connector in FIG. 3*b*, and finally during a stage of disconnection of the connector in FIG. 3*c;*

FIG. 1 shows an off-shore platform 200 on tension legs. This type of platform comprises a main hull 201 possessing a plurality of floats 202. Cables 300 extend from the bottom portions of the floats 202 down to respective connectors 100 for connecting the floats 202 to the sea bottom. For this purpose, each cable 300 is mounted on the male portion 102 of a connector 100 having its female portion 101 anchored to the sea bottom.

The cables 300 are put under tension in order to hold the main hull 201 so that its draught is greater than it would be in the absence of tension in the cables 300. Thus, the tension in the cables 300 serves to hold the platform 200 in a position that is stable in spite of large waves, strong ocean currents, or high winds.

FIG. 2 is an enlarged view of the connector 100. The female portion 101 of the connector 100 is in the form of a first tubular element, and the male portion 102 of the connector 100 that is mounted on a cable 300 presents the form of a second tubular element of a shape that is complementary to the female portion. The connector 100 is connected/disconnected by performing a movement in translation in combination with a movement in rotation between the male and female portions, as described in greater detail below.

The outer peripheral surface 103 of the male portion 102 has male shoulders 104 projecting from the surface 103 and arranged at regular intervals.

The male shoulders 104 are designed to be inserted beneath bearing surfaces 105' of female shoulders 105, the female shoulders 105 being formed on the inner peripheral surface 106 of the female portion 101 of the connector 100. The shape of the bearing surfaces 105' is complementary to the shape of the male shoulders 104. The bearing surfaces 105' are disposed at regular intervals relative to one another. The interval between two bearing surfaces 105' is large enough to allow a male shoulder 104 to pass between them.

Each of the male shoulders 104 is provided at its bottom end with a lug 104' projecting from the associated male shoulder. The lugs 104' are for inserting between pairs of ramps 107 & 109 and 108 & 110 of the female portion 101 of the connector 100.

The female portion 101 of the connector 100 has ramps 107, 108, 109, 110, and 3 located beneath the bearing surfaces 105' of the female shoulders 105. These ramps serve to guide the male portion 102, and more precisely the lugs 104' inside the female portion 101 during stages of connection, of disconnection, or of anti-disconnection.

They are subdivided into upper ramps 107 & 109, lower ramps 108 & 110, and ramps 3 disposed in an intermediate position between the upper and lower ramps 107 & 109 and 108 & 110.

The upper and lower ramps 107 & 109, 108 & 110 project from the inner peripheral surface 106 of the female portion 101 of the connector.

In contrast, the ramps 3 may be arranged in two positions.

In a first position, referred to below as a "retracted" position, the ramp 3 does not project from the peripheral inner surface 106 of the female portion 101 of the connector.

In a second position, referred to below as the "operating" position, the ramp 3 projects from said inner peripheral surface 106.

The actuation of a ramp 3 is explained in greater detail below, with reference to FIGS. 4 and 5.

The ramps 107, 108, 109, 110, and 3 present respective faces 111, 112, 113, 114, and 31 that are inclined relative to the longitudinal axis A of the female portion 101 of the connector 100. The angle of inclination $\alpha$ between the inclined faces 111, 113 of the upper ramps 107, 109 and the axis A lies for example in the range 30° to 60°, and is generally 45°. The angle of inclination $\beta$ between the inclined faces 112, 114 of the lower ramps 108, 110 and the axis A lies for example in the range 120° to 150°, and is generally 135°.

The angles $\alpha$ and $\beta$ are shown respectively in FIGS. 6*a* and 6*b*.

The ramps 107, 108, 109, 110 serve as guides for the lugs 104' of the male portion 102 of the connector during connection and disconnection stages of the connector 100.

For this purpose, the inclined faces 111, 113 of the upper ramps 107, 109 are directed downwards (angle $\alpha$ acute, FIG. 6*a*) and the inclined faces 112, 114 of the lower ramps 108, 110 are directed upwards (angle $\beta$ obtuse, FIG. 6*b*).

The ramps 3 are involved only during stages of undesired disconnection of the male portion 102 from the female portion 101 of the connector.

Connection Stage

The relative movement between the male and female portions 102 and 101 of the connector 100 during a connector connection stage is shown in FIG. 3*a*.

At the beginning of the connection stage, the male portion 102 lies in a position $P_0$.

The male portion is then caused to move downwards to a position $P_1$. This movement may be achieved using known means, e.g. the fact that the male portion 101 is connected to a ship on the surface via a deflector pulley. In this position $P_1$, the male portion 102 of the connector 100 comes into abutment against the inclined face 112 of a lower ramp 108.

This inclined face 112 obliges the male portion 102 to turn about its axis (rotation) while continuing to move downwards to a position $P_2$. This movement in rotation is represented by arrow F in FIG. 3*a*.

In the position $P_2$, the male portion 102 of the connector also comes into abutment against a vertical face of another lower ramp 110 facing the above-mentioned lower ramp 108.

The male portion 102 of the connector 100 is then guided by the lugs 104' between the two facing lower ramps 108, 110 in downward movement to a position $P_3$. The position $P_3$ corresponds to the lowest position of the male portion 102 relative to the female portion 101 of the connector 100. The outline of the male portion 102 in the position $P_3$ is also shown in FIG. 3*a*.

Thereafter, the male portion 102 of the connector 100 is subjected to upward movement to a position $P_4$ where it comes into abutment against the inclined surface 113 of an upper ramp 109. This may be achieved by releasing the tension exerted on the cable 300.

This inclined face 113 obliges the male portion 102 of the connector 100 to turn about its axis (rotation) while continuing to move upwards to a position $P_5$. This movement in rotation is likewise represented by arrow F in FIG. 3*a*.

In the position $P_5$, the male portion 102 of the connector also comes into abutment against a vertical face of another upper ramp 107 facing the above-mentioned upper ramp 109.

The male portion 102 of the connector 100 is then guided by the lugs 104' between the two facing upper ramps 107, 109 in upward movement to a position $P_6$. The position $P_6$ corresponds to the position in which the male portion 102 is connected to the female portion 101 of the connector 100.

In the position $P_6$, the male shoulders 104 of the male portion 102 are lodged under the bearing surfaces 105' of the female portion 101. This connection is held by the fact that the cable 300, to which the male portion 102 is attached, exerts upwardly-directed tension on the male portion 102 of the connector. This applies in particular when the cable 300 has been attached to an off-shore platform, which exerts force by virtue of its buoyancy.

During this connection stage, it should be observed that it matters little whether the ramps 3 are situated in the retracted position or in the operating position. It can be seen that only the upper and lower ramps 107 and 108 are involved in guiding the lugs 104' of the male portion during the connection stage.

Undesired Disconnection Stage

Figure 3B:
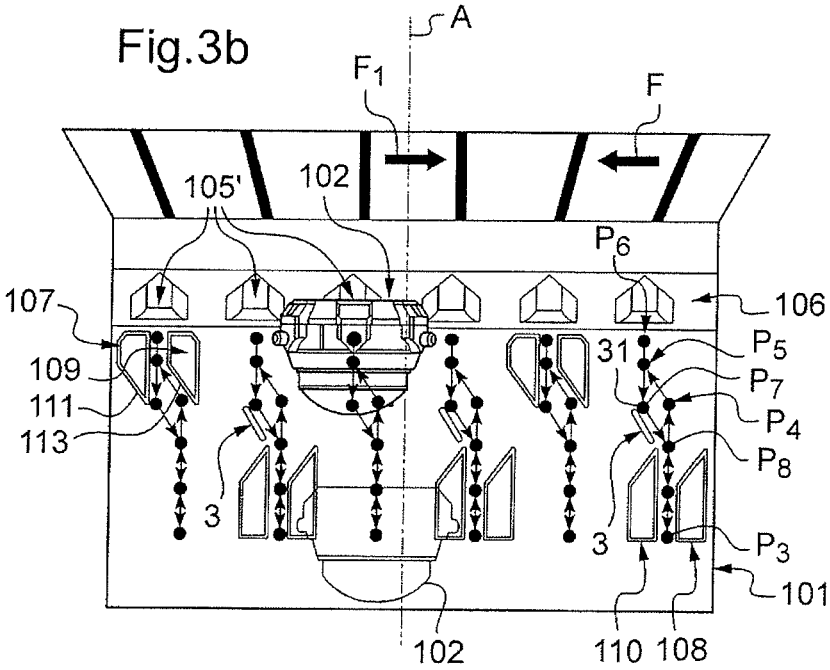

The ramps 3 are nevertheless involved in the event of an undesired disconnection stage occurring between the male and female portions 102 and 101, as explained below with reference to FIG. 3*b*. For this purpose, the ramps 3 are put into the operating position.

By way of example, an undesired disconnection may occur when the cable 300 is subjected to an event during which its tension decreases, so that it no longer exerts sufficient traction force on the male portion 102 to keep it in contact with the female portion 101.

At the beginning of this stage, the male portion 102 is situated in the position $P_6$. This is the connection position of the connector 100.

In the event of an undesired downward movement occurring, the male portion 102 moves down to a position $P_7$. In this position $P_7$, the male portion 102 of the connector 100 comes into abutment against the inclined face 31 of a ramp 3.

The angle of inclination $\alpha'$ between the face 31 of a ramp 3 and the longitudinal axis A of the female portion 101 of the connector is an acute angle, e.g. lying in the range 30° to 60°. The angle $\alpha'$ generally lies in the range 30° to 45°, and is preferably 45°. The angle $\alpha'$ is preferably equal to the angle $\alpha$. The angle $\alpha'$ is shown in FIG. 6*c*.

This inclined face 31 obliges the male portion 102 to turn about its axis (rotation) while continuing to move downwards to a position $P_8$, by acting via the lugs 104'. The direction of rotation imparted by the ramps 3 to the male portion 102 of the connector 100 is represented by arrow $F_1$ in FIG. 3*b*. In position $P_8$, the male portion 102 of the connector is brought into register with the space between the facing lower ramps 108, 110, and more precisely it comes into abutment against the inclined face 112 of the lower ramp 108.

Depending on the magnitude of the undesired movement applied to the male portion 102 of the connector 100, the male portion 102 may be guided between two facing lower ramps 108, 110 in a downward movement to the position $P_3$. The outline of the male portion 102 is shown in the position $P_3$ in FIG. 3*b*. It may also occupy any intermediate position between the position $P_8$ and the position $P_3$, or indeed it need not move down any further than the position $P_8$.

Once this last position has been reached, the movement of the male portion 102 corresponds to the movement that it performs during a connection stage.

When upward tension is once more exerted on the cable 300, the male portion 102 of the connector 100 is subjected to an upward movement to the position $P_4$ where it comes into abutment against the inclined surface 113 of an upper ramp 109.

The inclined face 113 then obliges the male portion 102 of the connector 100 to turn about its axis (rotation) while continuing its upward movement to the position $P_5$, under action from the lugs 104'. This movement in rotation continues to be represented by arrow F in FIG. 3*b*.

In the position $P_5$, the male portion 102 of the connector also comes into abutment against a vertical face of another upper ramp 107 facing the above-mentioned upper ramp 109.

The male portion 102 of the connector 100 is then guided between two facing upper ramps 107, 109 in an upward movement up to the position $P_6$. The position $P_6$ corresponds to the position in which the male portion 102 is connected to the female portion 101 of the connector 100.

During this undesired disconnection stage, it can be seen how important the ramps 3 are when arranged in the operating position. They serve to guide the male portion 102 of the connector from the position $P_5$ to the position $P_8$, from which the only movements that can be performed by the male portion are movements that necessarily lead to connection.

Disconnection Stage

In order to disconnect the connector 100, the ramps 3 are in their retracted position. Under such conditions, the connector 100 operates as though the ramps 3 did not exist. For reasons of simplification, they are omitted from FIG. 3*c* to which reference is made when describing the disconnection step.

At the beginning of the disconnection stage, the male portion 102 is situated in the position $P_6$.

The male portion 102 is then caused to perform a downward movement to a position $P_9$. In this position $P_9$, the male portion 102 of the connector 100 comes into abutment against the inclined face 114 of a lower ramp 110.

This inclined face 114 obliges the male portion 102 to turn about its axis (rotation) while continuing to move downwards to a position $P_{10}$ under action of the lugs 104'. This movement in rotation is represented by arrow F in FIG. 3*c*.

The male portion 102 of the connector 100 is then guided along a vertical wall 116 of the lower ramp 110 in downward movement to a position $P_{11}$. The position $P_{11}$ corresponds to the lowest position of the male portion 102 relative to the female portion 101 of the connector 100 during this disconnection stage.

Thereafter, the male portion 102 of the connector 100 is subjected to upward movement to the position $P_{12}$ where it comes into abutment against the inclined surface 111 of an upper ramp 107.

This inclined face 111 obliges the male portion 102 of the connector 100 to turn about its axis (rotation) while continuing to move upwards to a position $P_{13}$ under the action of the lugs 104'. This movement in rotation continues to be represented by arrow F in FIG. 3*c*.

The male portion 102 of the connector 100 is then guided along a vertical wall 117 of the upper ramp 107 in upward movement to a position $P_{14}$. The position $P_{14}$ corresponds to the position for disconnecting the male portion 102 from the female portion 101 of the connector 100. The relative position of the male and female portions 102 and 101 is then the same as in the position $P_0$ shown in FIG. 3*a*.

There follows a description of an anti-disconnection device serving to actuate a ramp 3, this description being with reference to FIG. 4, with operation thereof being described with reference to FIGS. 5*a* and 5*b*.

The anti-disconnection device 1 has a wall 2 with a slot 21, a ramp 3 suitable for being moved through the slot 21 between a first position (retracted position shown in FIG. 5*a*) and a second position (operating position shown in FIG. 5*b*), and means 4 for actuating the movement of the ramp 3 through the slot 21 between these two positions.

The anti-disconnection device 1 is designed to be implanted on the female portion 101 of the connector 100 from the outside. For this purpose, the wall 2 presents a radius of curvature that corresponds to the radius of curvature of the female portion 101 of the connector. The wall 2 of the anti-disconnection device 1 is thus of a shape that is complementary to the female portion 101 of the connector.

In order to enable the connector 100 to receive the wall 2 of the anti-disconnection device 1, the female portion 101 has an opening for passing the ramp 3 of the anti-disconnection device 1.

The means 4 for actuating movement of the ramp 3 comprise a counterweight 41, an intermediate part 42 disposed between the wall 2 and the counterweight 41, and a rod 43 having one end fastened to the ramp 3 and having its other end connected to the counterweight 41 by means of a pin 46.

The intermediate part 42 serves as a hinge support for the counterweight 41 and in order to support the counterweight 41 it is fastened to the wall 2. More precisely, the counterweight 41 is pivotally mounted at 44 relative to the intermediate part 42.

The intermediate part 42 has an orifice (no reference) for passing the rod 43 connecting the ramp 3 to the counterweight 41.

When the counterweight 41 pivots relative to the intermediate part 42, the rod 43 can move in translation along its own axis.

The intermediate part 42 also has an abutment function for the counterweight 41. As shown in FIG. 5*b*, the counterweight comes into abutment against the intermediate part 42 so as to stop the stroke of the ramp 3 when the ramp passes from its retracted position to its operating position.

The means 4 also include a handle 45 making it possible to keep the ramp 3 in its operating position.

In natural manner, the counterweight 41 holds the ramp 3 in its retracted position (FIG. 5*a*).

That is why a cord (not shown), e.g. made of polypropylene, is generally installed around the handle 45 so as to hold the ramp 3 in its operating position. The cord is generally put into place outside the water.

When it is desired to disconnect the male portion 102 from the female portion 101 of the connector, the cord is detached or cut by any appropriate means.

The operation of detaching the cord may be performed remotely, which is preferable for reasons of safety.

In a variant, the cord may be detached or cut by means of an undersea robot.

In another variant, the ramp 3 may be held in its operating position by a pin system in stead of a cord system.

A protective frame 5, generally made of tubes, is fastened to the outside face 23 of the wall 2 and is also designed to protect the anti-disconnection device 1 against elements outside the connector 100. It presents the form of a tubular frame 5, which frame also constitutes an attachment point for an undersea robot making it easier to operate when actuating the anti-disconnection device 1.

The person skilled in the art will understand that a plurality of locking devices 1 are used on each connector. For example, for the connector shown in FIGS. 2 and 3, the number of ramps 3 is half the number of lower ramps 108, 110 (or half the number of upper ramps 107, 109).

What is claimed is:

1. An undersea connector for connecting an oil installation to the sea bottom, the connector being of the type presenting a first tubular element forming a female portion for fastening to the ocean bottom and a second tubular element forming a male portion for connection to the oil installation, wherein the connector comprises:

at least one anti-disconnection device for the connector, the device being housed in the female portion and comprising means for positioning the device in a first position in which the connector is capable of being disconnected, or else in a second position in which the connector cannot be disconnected, said means for positioning the anti-disconnection device in the first position or in the second position comprising:

a wall provided with a slot, a ramp suitable for moving through the slot between the first position, which corresponds to a position in which the ramp does not project from a peripheral inner surface of the female portion of the connector, and the second position, which corresponds to a position in which the ramp projects from said inner peripheral surface, and means for actuating movement of the ramp through the slot between these two positions, upper ramps and lower ramps for guiding the male portion in the female portion during stages of connection, of disconnection, or of anti-disconnection, the ramp of said at least one anti-disconnection device being arranged in an intermediate position between the upper ramps and the lower ramps such that, when the ramp is in the second position, the ramp serves to guide the male portion inside the female portion from the upper ramps towards the lower ramps to ensure the anti-disconnection of the device.

2. A connector according to claim 1, wherein the wall of the anti-disconnection device is complementary in shape to the female portion of the connector.

3. A connector according to claim 1, wherein the means for actuating the movement of the ramp through the slot of the wall comprise:

a counterweight;

an intermediate part arranged between the wall and the counterweight, said part being fastened to the wall to support the counterweight, the counterweight being pivotally mounted relative to said intermediate part; and a rod having one end fastened to the ramp and having its other end mounted on the counterweight in such a manner that the rod moves axially when the counterweight pivots relative to the intermediate part.

4. A connector according to claim 1, wherein the anti-disconnection device includes a protective frame fastened on an outside face of the wall.

5. A connector according to claim 4, wherein the protective frame presents the shape of a tubular frame so that it can be gripped by an undersea robot.

6. A connector according to claim 1, wherein the ramp includes an inclined face that is inclined relative to the longitudinal axis of the female portion of the connector by an angle $\alpha'$ lying in the range 30° to 60°.

7. A connector according to claim 6, wherein the angle of inclination $\alpha'$ is identical to the angle of inclination $\alpha$ between a face of an upper ramp and the longitudinal axis of the female portion of the connector.

8. A connector according to claim 6 wherein the angle of inclination $\alpha'$ is 45°.

* * * * *